US005180894A

United States Patent [19]

Quick et al.

[11] Patent Number: 5,180,894

[45] Date of Patent: Jan. 19, 1993

[54] TUBE FROM MICROWAVE SUSCEPTOR PACKAGE

[75] Inventors: James R. Quick, Greenwood Lake, N.Y.; James L. Alexander, Memphis, Tenn.; Christopher C. Lai, Battlecreek, Mich.; Susan A. Matthews, Mobile, Ala.; Donna J. Wenzel, Middletown, N.Y.

[73] Assignee: International Paper Company, Purchase, N.Y.

[21] Appl. No.: 540,069

[22] Filed: Jun. 19, 1990

[51] Int. Cl.[5] ..... H05B 6/80

[52] U.S. Cl. ..... 219/10.55 E; 219/10.55 F; 426/107; 426/113; 426/234; 229/DIG. 3; 99/DIG. 14

[58] Field of Search ..... 219/10.55 E, 10.55 F; 426/107, 109, 113, 114, 234, 241, 243; 229/903, 905, DIG. 3; 99/DIG. 14

[56] References Cited

U.S. PATENT DOCUMENTS

| | | | |
|---|---|---|---|
| 1,373,136 | 3/1921 | Kranz . | |
| 1,627,583 | 5/1927 | Thum . | |
| 3,038,811 | 6/1962 | Reading . | |
| 3,554,770 | 1/1971 | Lipsky . | |
| 3,827,614 | 8/1974 | Baxter . | |
| 4,015,085 | 3/1977 | Woods | 219/10.55 E |
| 4,530,440 | 7/1985 | Leong . | |
| 4,676,857 | 6/1987 | Scharr et al. | 219/10.55 E |
| 4,735,513 | 4/1988 | Watkins et al. | 219/10.55 E |
| 4,775,771 | 10/1988 | Pawlowski | 219/10.55 E |
| 4,797,010 | 1/1989 | Coelho | 426/133 |
| 4,835,352 | 5/1989 | Sasaki et al. | 219/10.55 E |
| 4,857,342 | 8/1989 | Kappes | 426/107 |
| 4,861,957 | 8/1989 | Welles | 219/10.55 E |
| 4,865,854 | 9/1989 | Larson | 426/107 |
| 4,865,921 | 9/1989 | Hollenberg | 426/107 |
| 4,866,232 | 9/1989 | Stone | 219/10.55 E |
| 4,873,101 | 10/1989 | Larson | 426/113 |
| 4,890,439 | 1/1990 | Smart et al. | 219/10.55 E |
| 4,894,247 | 1/1990 | Fong | 426/107 |
| 4,950,859 | 8/1990 | Anderson | 219/10.55 E |

*Primary Examiner*—Philip H. Leung
*Attorney, Agent, or Firm*—Michael J. Doyle; Walt Thomas Zielinski

[57] ABSTRACT

A flexible, open ended microwave cooking tube formed of paper. The paper is provided with a layer of microwave susceptor material such as vacuum deposited metal. The tube is formed of a rectangular blank of the stock comprised of the paper and microwave susceptor material. A pair of opposite, parallel ends of the blank are seamed together and are provided with handle forming holes. In operation, a food item is placed within the tube. During the cooking process, the susceptor material reaches the high temperature required to brown and crispen the food. The seamed, handle portion of the tube, not being provided with susceptor material, remains relatively unheated and is hence less dangerous to the user when the tube and food are removed from the microwave oven. The tube can be formed from a continuous length of the paper/susceptor stock and wound into a roll. Short lengths of the tube can then be cut from the roll to provide individual containers for microwave cooking.

8 Claims, 5 Drawing Sheets

FIG. 1
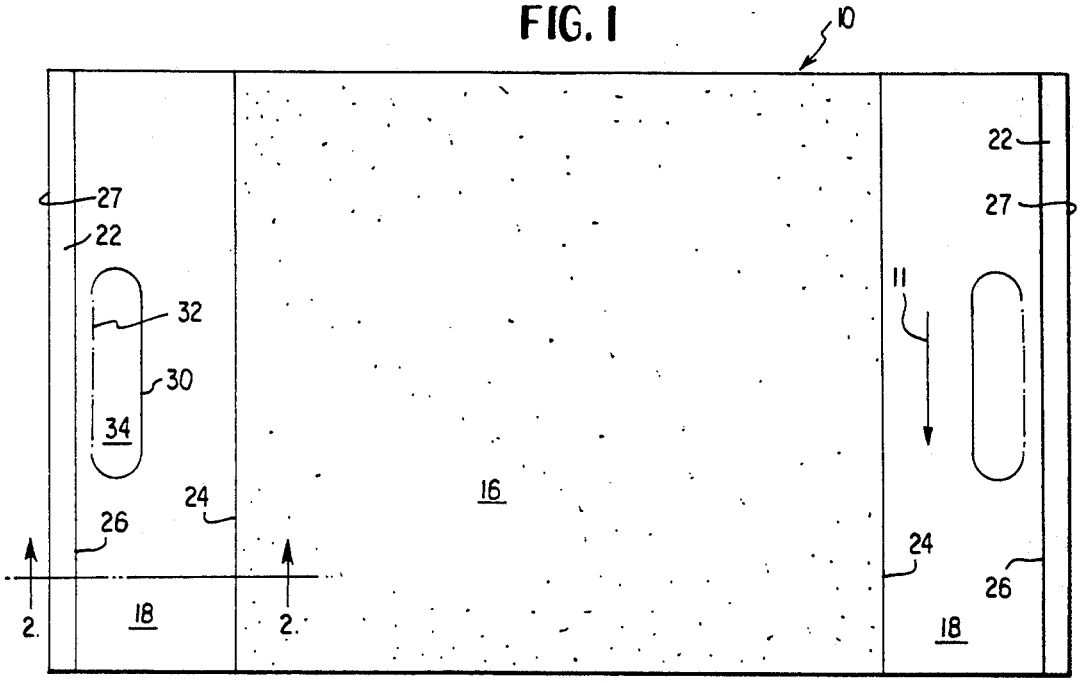
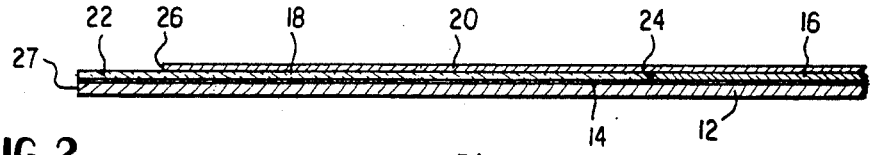
FIG. 2
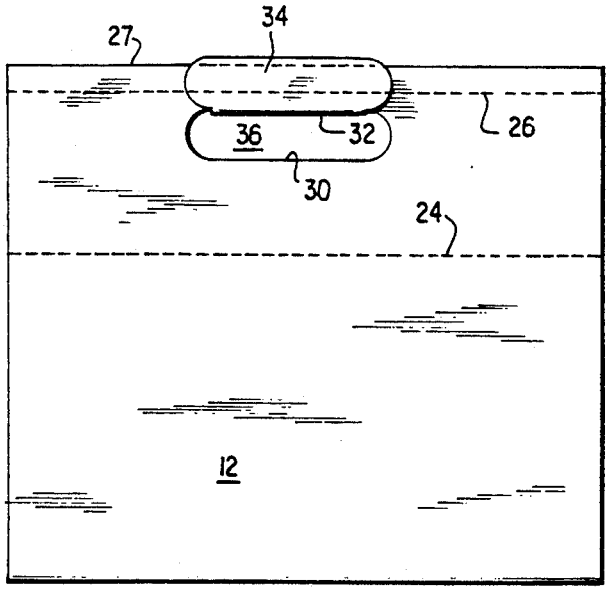
FIG. 3

FIG. 3A
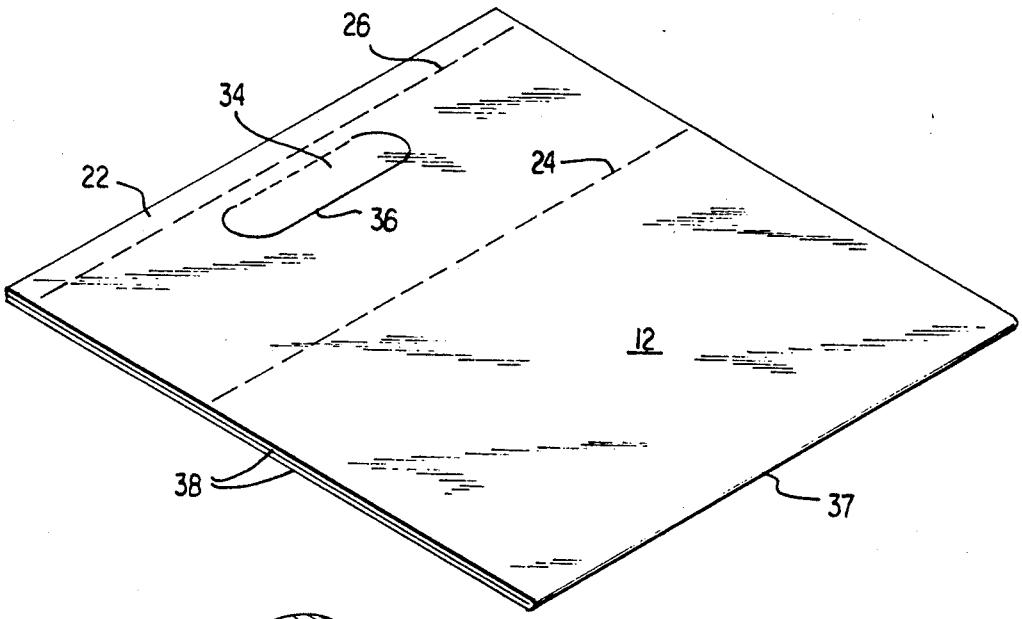
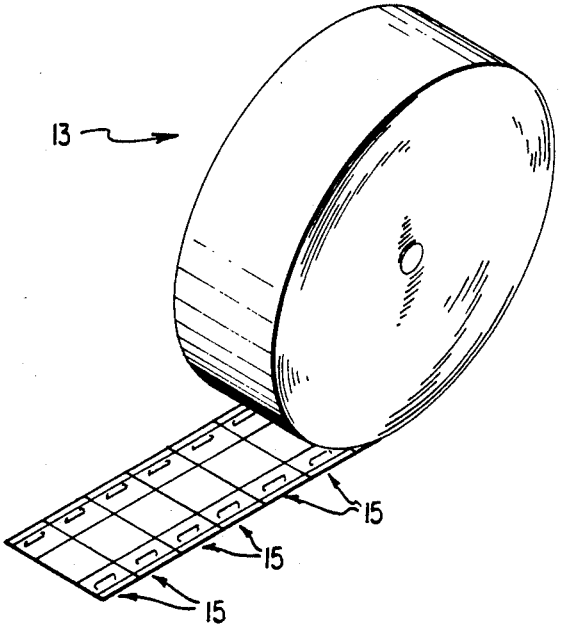
FIG. 12
FIG. 13
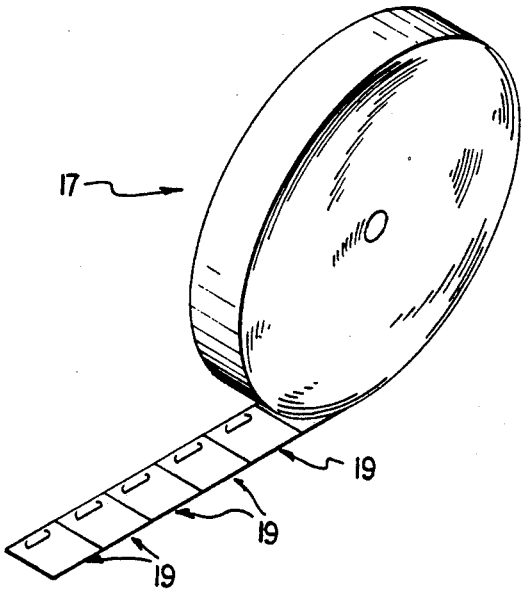

TUBE FROM MICROWAVE SUSCEPTOR PACKAGE

BACKGROUND OF THE INVENTION

This invention relates to a food package and to a container for forming the package. The package exhibits particular utility in the microwave cooking art.

In spite of its appeal for fast cooking of food stuffs, microwave cookery has until fairly recently been limited by the inability of microwave ovens to brown and crispen foodstuffs, such as dough products and breaded items. Although cooked, the absence of browning and crispness on the surface of a food item, or at least on a portion of its surface, does not yield the desired texture or fully cooked appearance and hence lacks appeal to many consumers. Within recent times, however, advances in microwave cooking technology have been made to at least partially overcome this problem. Namely, one or more materials are now available, often termed susceptor material, which are typically applied to a surface of a food package. Typically, the susceptor material is defined by a thin layer of a metal, such as aluminum, which has been vacuum deposited on a plastic film carrier. Such a susceptor material has the property of absorbing at least a portion of the microwave energy from the oven and transforming it into heat. By virtue of intimate thermal contact between one or more surfaces of the food product with such a susceptor material layer, browning and crisping of foodstuffs in microwave ovens can be realized.

It is accordingly now common for consumers to purchase frozen packaged food products, which can be placed in a microwave oven and cooked and browned. However, many of the existing package concepts suffer from shortcomings which limit their utility, add substantial bulk to the total package or cause the consumer to perform difficult manipulations of the food and the container. Bags and sleeves incorporating metallized plastic films as microwave susceptor materials have been considered as alternatives to existing forms of microwave food containers, but these too have had a number of shortcomings. For example, some earlier designs resulted in unacceptably long cooking times because the metallized film used as the microwave susceptor material covered the full internal area of the bag or sleeve and thus partially shielded the food from direct radiation with microwave energy. Further, such prior constructions were not well suited for food products requiring browning or crisping on only one side, or conversely, if designed for single side browning or crisping, then they were not suited for food products requiring browning and crisping one two sides. Other drawbacks included overheating and charring of paper in areas where plies of metallized film were overlapped, and the prior constructions also were not readily adaptable for food products of different sizes. Prior constructions also were nonuniform in thickness when folded flat and therefore not suitable for handling in roll form. Additionally, often there was no provision for draining or collection of liquids such as grease or water often exuded by the food during cooking and no provision was made for easy handling during placement in the microwave oven and removal from the oven at the completion of the cooking process.

SUMMARY OF THE INVENTION

According to the practice of this invention, a susceptor container for forming a food package is provided which overcomes these drawbacks of the prior art. A tube form microwave susceptor container is formed by glueing or otherwise joining together the ends of a precut and generally rectangular blank of paper or the like which has been provided on at least a portion of one of its surfaces with a layer of microwave susceptor material. A food release coating is applied on the surface of the blank corresponding to the internal surface of the final container. The lengthwise running ends of the rectangular blank are glued or otherwise affixed together in overlapping, surface to surface relation.

The resultant and tube structure may be provided with handle openings near its joined lengthwise running end portions. In use, the tube container is open at both ends to enable it to accept a food product which is placed on its inner surface. The resultant package, i.e., the container and the product therein, is then placed in a microwave oven and cooked. The open ends of the tube permit direct radiation contact between the food product and the microwave energy in the oven. Also, radiation contact of the microwave energy with the food is permitted by any portion of the area of the tube which is positioned above the food and which does not include any susceptor material, and it is within the province of this invention to vary the extent of coverage of the tube area with susceptor material over a wide range. That portion of the food product which rests upon the bottom of the tube becomes browned or crispened. Another mode of use is to provide the container of this invention with a layer of microwave susceptor material over most of the area of the container and place the food product in the tube, with both the top and bottom surfaces of the food product being in contact with those container surfaces heated by the layer of susceptor material.

The portions of the blank which are sealed together are preferably not provided with the susceptor material so that they do not become heated during dwell time in the microwave oven. This enables the user to remove the package from the oven by grasping this portion of the container without injuring the fingers by burning. The microwave energy in the oven only slightly heats this portion of the container.

BRIEF DESCRIPTION OF THE DRAWINGS

FIG. 1 illustrates a blank from which the container of this invention is formed.

FIG. 2 is a view taken along Section 2—2 of FIG. 1.

FIG. 3 is a plan view showing the blank in the assembled condition.

FIG. 3A is a perspective view showing a flattened form of the container.

FIG. 12 illustrates a roll of the laminated and coated stock used to produce the containers of this invention.

FIG. 13 illustrates a roll of the flattened tube stock that can be cut into pieces to provide the containers of this invention.

DETAILED DESCRIPTION OF THE INVENTION

Figure 4:
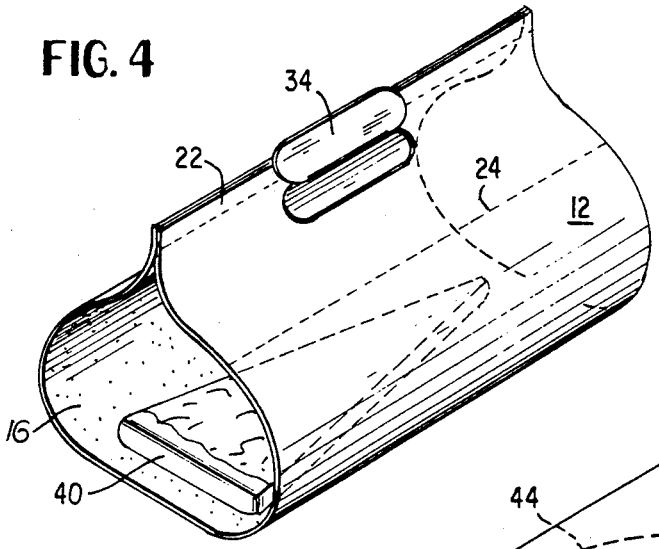
FIG. 4 illustrates a package formed by the container of this invention and ready for use in a microwave oven.

Referring now to FIG. 1, the blank 10 from which the container is formed is shown, the blank being generally rectangular and as shown in FIG. 2, includes a lower layer of paper 12. A layer of adhesive 14 lies on top of paper 12. The central portion of the blank, is provided with a metallized film 16 such as vacuum deposited aluminum indicated by stippling at FIG. 1. This susceptor material extends from the center, to the left and to the right, and terminates at edges indicated at 24. From edges 24 of susceptor layer 16, to the left and right blank edges, a clear film 18 is provided as shown in FIG. 2. Both the clear film layer 18 and susceptor material layer 16 are coplanar and are fixed to paperboard substrate 12 by adhesive layer 14. The clear film layer extends from edges 24 of metallized film 16 to left and right free edges 27 of the blank.

A food release coating 20 may be applied on the surface of the blank 10 corresponding to the internal surface of the final container. The food release coating 20 covers substantially all of the internal surface but terminates at lines 26. Thus the food release coating does not extend into the narrow, lengthwise running bands 22 at each end of the blank.

In referring to the length and width of blank 10 and the tube form containers of this invention, the length in all cases will be the dimension running in the direction of edges 27, as shown by arrow 11, although this may not be the longest dimension of the blank in many cases. In a commercial manufacturing process which will be described later in this specification, the direction in which the material runs through a laminating and coating machine, i.e. the machine direction, corresponds to the running direction of edges 27, regardless of the proportions of the blank. To avoid confusion, this machine direction will be the basis throughout this specification for defining the length of the blank and the tube form containers made therefrom.

Each end region of the blank may be cut as indicated at 30 to define an oblong flap 34 pivotal about fold line 32 to form handle opening 36.

The narrow, lengthwise running bands 22 at each end of the blank are adhesively secured together in surface to surface contact to form the container shown at FIGS. 3 and 4. A food item such as a slice of uncooked pizza 40 is placed inside the container. The package is then placed inside a microwave oven, cooked for a suitable amount of time, and removed by grasping the handle defined by the openings. From demarcation edge 24 to the top edge of the container there is no susceptor material 16 and those zones do not thus become heated by microwave energy to a high degree, thus minimizing danger of burn to the fingers of the user when removing the package from the microwave oven.

Figure 5:
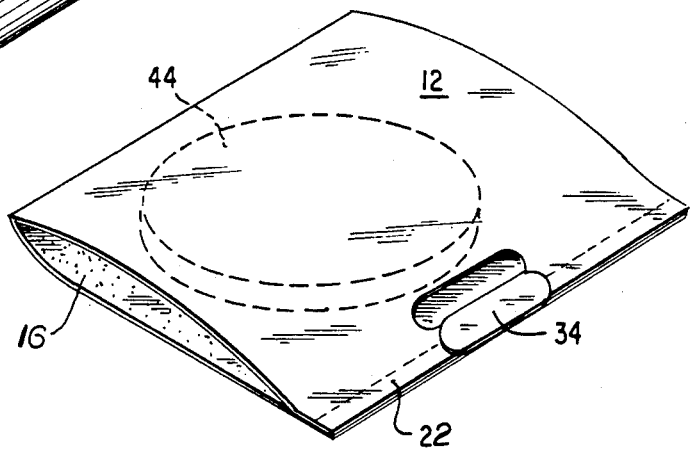
FIG. 5 is a view illustrating an alternative method of cooking using the container of this invention.

FIG. 5 illustrates an alternative mode of use of the container of this invention for a flat food product, such as a bread product 44 (shown in dashed lines) which is to be browned on both sides.

In the flattened form shown at FIG. 3A, the container of this invention has a uniform thickness equal to two thicknesses of blank 10. In FIG. 3A the layers 12, 14, 16, 18 and 20 of the blank 10 are not shown individually. In this figure a single layer of material 38 represents the combination of the multiple layers of the blank 10. In this flattened form, each flap 34 is positioned in the respective handle opening 36. This flattened form can be advantageous over forms of nonuniform thickness for purposes of distribution of the container to food packagers and for distribution to consumers for use with food items prepared at home. Specifically, the container can be manufactured as a long tube, of a length equal to many individual containers, and the tube can be flattened and wound into a roll. This is not readily done with tube stocks of nonuniform thickness because a roll will be of nonuniform diameter, with soft spots corresponding to the thinner portions of the stock. The design of the container of this invention permits the preparation of rolls of the tube stock of uniform diameter that can be run on machinery used by the food packager or easily handled by the consumer in the form of small rolls similar to other household paper and plastic products.

It will be advantageous in some cases to use certain known techniques to improve the quality of rolls formed from the flattened tube stock. The uniform thickness of the flattened tube makes the material generally suitable for forming rolls of substantial length, but there are two potential causes of defects in the wound rolls. First, on each turn around the roll, one face of the flattened tube must cover a slightly greater circumference than the other face, and this difference, although small, will accumulate with each successive turn. This can result in wrinkles, random folds or other defects in the roll. This problem can be dealt with by cutting transverse slits in the tube stock before it is wound into a roll. The configuration of these slits and their length running across the width of the tube stock, and the frequency of slits along the length of the tube stock will vary depending on the thickness of the tube stock, the diameter of the core used for the roll and the length of the roll. In any case, the frequency of the slits need not be such that a significant portion of the tube stock is affected. The second factor that may adversely affect roll quality is that the tube stock may be of a slightly greater thickness along either the folded edge 37 or along the adhesively bounded bands 22, as compared with the thickness of the rest of the flattened tube stock. If this causes unevenness in the wound roll of tube stock, either edge of the tube, or both, may be run through a set of pinch rollers or a similar device to reduce the thickness in the troublesome area so that it is no greater than the thickness of the rest of the area of the flattened tube. Other methods of insuring defect-free rolls of tube stocks may be used in specific cases, depending on the composition of the stock, the roll dimensions and the capabilities of available converting equipment. In some cases, good quality rolls may be formed without employing any measures of the sort just discussed.

Figure 6:
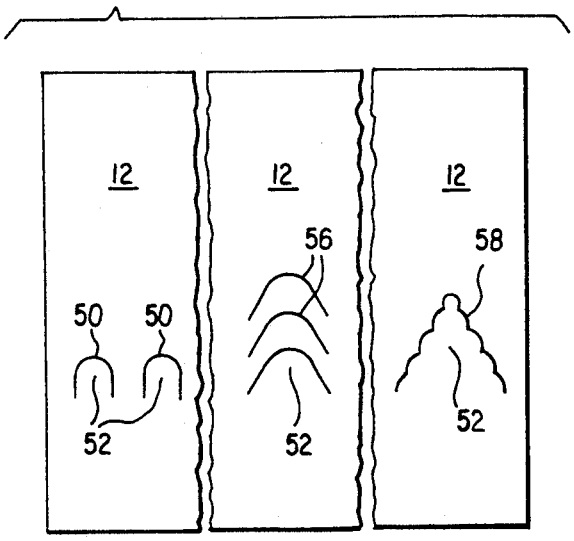
FIG. 6 illustrates three embodiments for placement of vent openings in the sides of the container of this invention.
Figure 7:
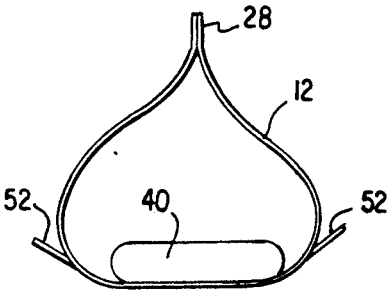
FIG. 7 is the end view of the package of this invention provided with any of the vent arrangements shown in FIG. 6.

Referring now to FIGS. 6 and 7, FIG. 6 shows three variations of cuts 50, 56 and 58 to form one or more vent holes forming flaps 52. After bending the flaps away from the plane of the blank the vent holes are formed. FIG. 7 is an end view showing the bent flaps. A food product 40 is indicated as within the container with the vent holes further facilitating exit of any cooking gases from the container.

Figure 8:
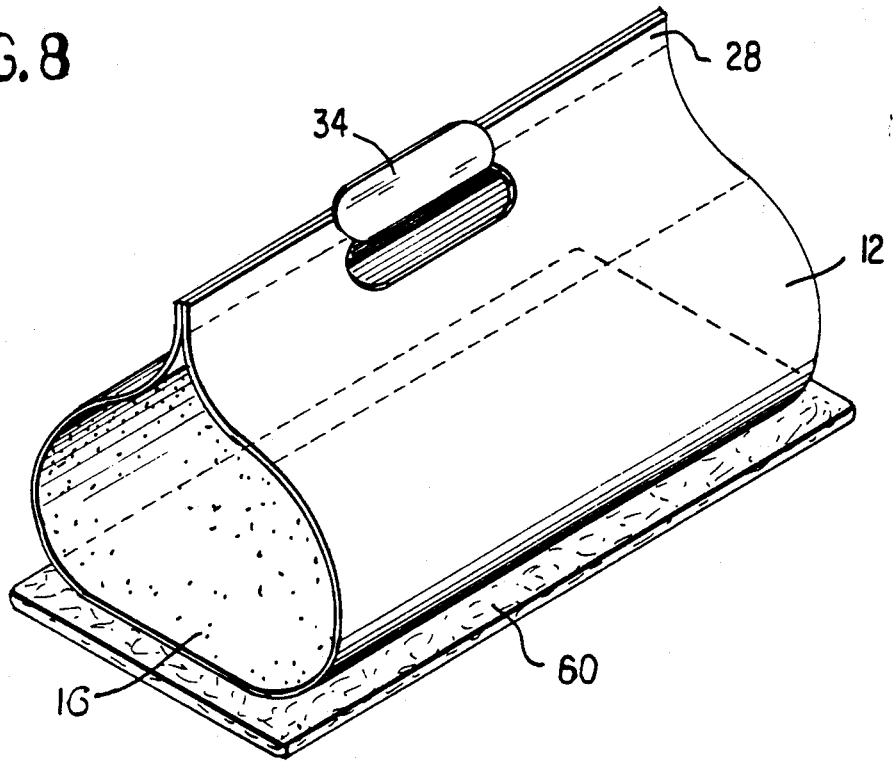
FIG. 8 is a view similar to FIG. 4, and illustrates the container of this invention provided with a water/-grease absorbent pad.
Figure 9:
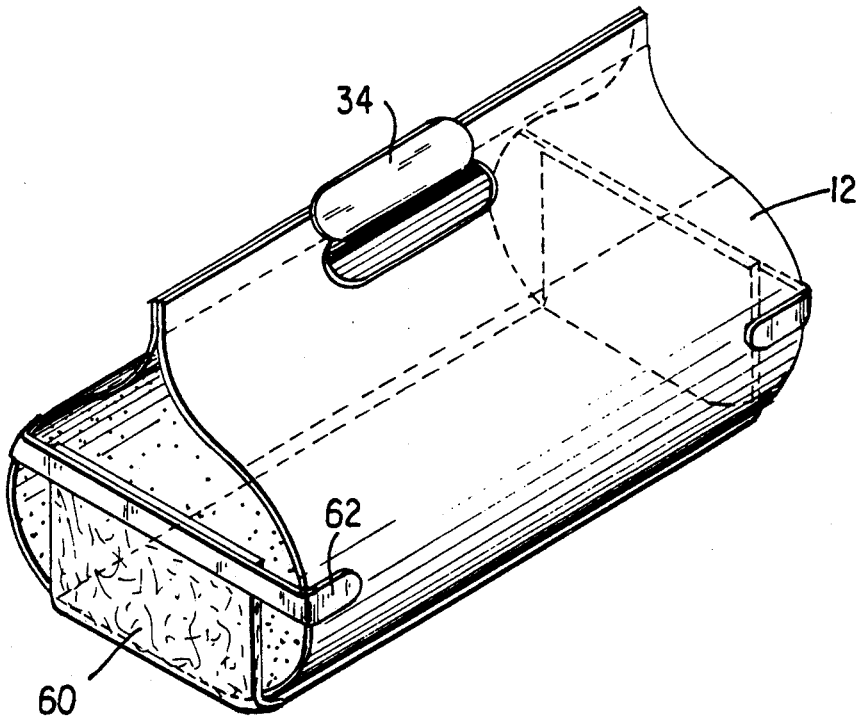
FIG. 9 is a view similar to FIG. 8, and illustrates a modification wherein the absorbent pad is somewhat elongated to partially close the ends of the tube.

FIGS. 8 and 9 show a variation which includes an absorbent pad 60, formed of any suitable non-woven material for example, and affixed as by adhesive to the bottom wall of the container. In FIG. 8, the end edges of absorbent pad 60 extend beyond the ends of the container, so that water or grease or other exudate released from a food product during cooking is absorbed and will not soil the microwave oven. In FIG. 9, the length of absorbent pad 60 is somewhat greater, with tapes 62 being employed to hold the ends of the pad up and more positively interrupt and absorb the flow of water or grease from a food product being cooked.

Figure 10:
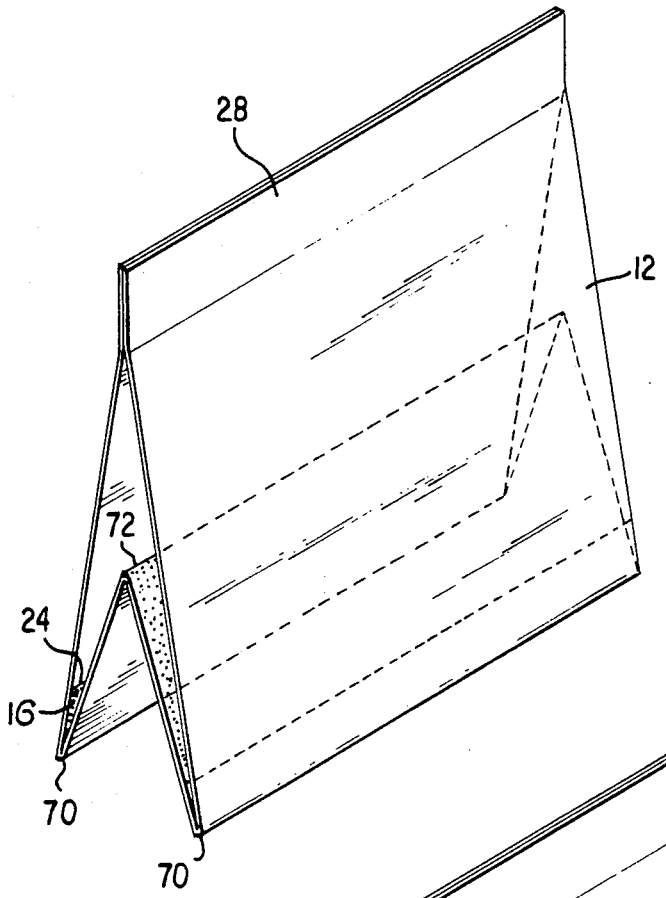
FIG. 10 is a perspective view illustrating another form of the invention.
Figure 11:
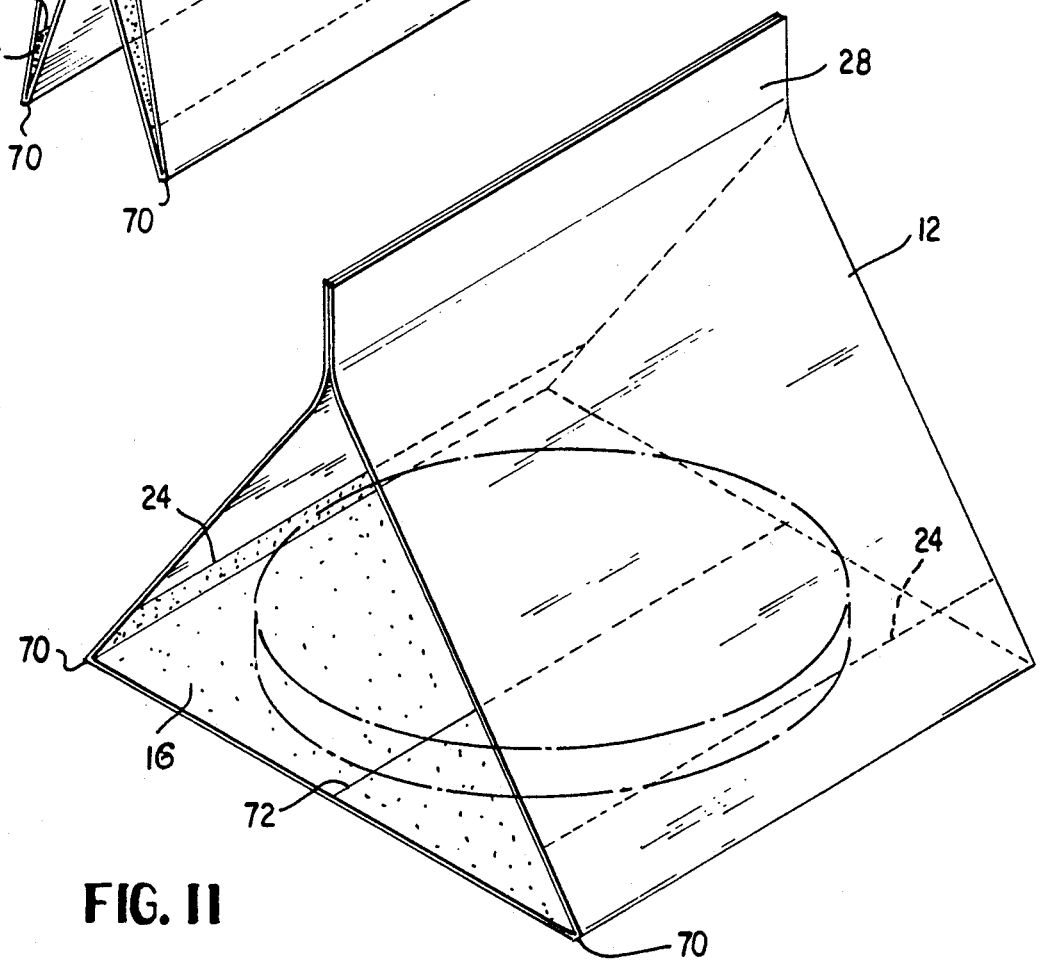
FIG. 11 illustrates the modification of FIG. 10 forming a food package ready for placement in a microwave oven.

FIGS. 10 and show a modification when the blank is provided with parallel fold lines 70, equally spaced from the center of the blank and with a central fold line 72 also extending across the length of the blank. This permits the formation of gussets to enable the container to open to a flatter condition as shown at FIG. 11. Fold line 72 facilitates folding of the container. The container shown at FIGS. 10 and 11 can be readily configured in a gusseted form as shown at FIG. 10 and then collapsed further with the gusset folded inward to provide a relatively thin form to facilitate distribution of the containers to food packagers or to consumers. Alternately the container can be configured with the gusset turned outwards to provide the thinner flattened form as shown at FIG. 3A.

The blanks required to produce the containers of this invention are most readily prepared by a laminating and coating process which yields an essentially continuous length of material of the width of a single blank, wound in roll form. A specific set of materials suitable for the manufacture of the construction shown at FIG. 2 consists of the following:

1. An uncoated bleached white paper stock, specifically Springhill offset paper with a basis weight of 60 pounds per 3000 sq ft supplied by International Paper Co. in Memphis Tennessee.

2. A stripe metallized polyester film with the area of matallization and the areas not metallized corresponding respectively to areas 16 and 18 of blank 10 shown at FIG. 1. Stripe metallized polyester films are available from Madico, Inc. in Woburn, Massachusetts. Hostaphan 2400 polyester film from American Hoeschst Corp. in Greer, South Carolina is a suitable base film and can be used in any thickness in the general range of 0.0005" to 0.005". In the metallization process, the deposition of aluminum in the required area can be controlled by methods well known to those experienced in the art of vacuum metallization. The finished film should have an optical density in the range of about 0.15 to about 0.30 in the metallized area, when tested after a suitable aging period of 3–4 days.

3. A suitable adhesive for laminating the paper and film is supplied by Air Products and Chemicals, Inc. in Allentown, Pennsylvania. Airflex 421 is a water-based vinyl acetate-ethylene copolymer adhesive that can be used directly in the laminating operation without modification.

4. The requirement for a food-release coating is satisfied with #42046 Waterbase Food Release Coating from Roymal, Inc. in Newport, New Hampshire.

The materials described above can be converted to the laminated stock shown at FIG. 2 using a conventional wet bond laminator. On a typical machine of this type the laminating step and the application of the food release coating will be completed as separate steps. For the laminating step the adhesive may be applied to either the paper substrate or the metallized surface of the film, or both, and then the paper and film are joined in a pressure nip with the machine running at about 200–800 feet per minute. A suitable adhesive application level will usually be in the range of about 2–5 pounds per 1000 sq ft and a typical level of about 3 pounds per 1000 sq ft can be applied with a 110 line gravure applicator roll. Following the pressure nipping of the paper and the film with the adhesive layer sandwiched therein, the laminated stock may be run through a hot air curing oven to affect the setting of the adhesive bond. A suitable oven temperature for stock running at speeds of 300–600 feet per minute will be about 300 to about 500 degrees F. Finally, the laminated stock will be rewound, possibly after passing over a chill roll after exiting the curing oven. The rewound laminated stock will be returned to the unwind stand of the laminating machine and run through the machine again for application of the food-release coating. For this step the food release coating is applied on the film surface of the laminated stock using a 200 line gravure roll and then the stock is run through the oven at a speed of about 300 feet per minute with an oven temperature of about 400 degrees F. Finally, the coated stock is wound into a roll suitable for transporting to another location for the manufacture of the tube form containers of this invention.

The laminated and coated stock can be cut into pieces to provide the blanks for making individual microwave food containers, or the stock can be used in roll form to feed a converting machine. A roll of the laminated and coated stock 13 as shown at FIG. 12 may have a series of cut lines 15 to define where transverse cuts will be made to produce individual blanks. When the stock is to be retained in roll form for conversion to tube form, then lines 15 may not be required. Of course it will generally be preferable to utilize the stock in roll form for commercial production, while the use of individual blanks is important as a method of making a limited quantity of containers for developmental purposes. In either case, the process of making the tube form containers of this invention from the laminated and coated stock will include a folding step and a bonding step. In the folding step the stock is folded along one or more parallel fold lines to permit the bands 22 along opposite ends of the stock to be brought together with their facing surfaces being the same as the surface of the stock that will comprise the interior surface of the container. In the bonding step, the bands 22 are secured together via the application of an adhesive or by any other suitable means. A preferred method consists of applying a hot melt adhesive in the form of a narrow bead along the length of one band 22 and then pressing the other band 22 into place while the adhesive is still in a flowable state. A highly suitable hot melt adhesive for this purpose is a polyamide hot melt adhesive, Macromelt 6211 from Henkel Corp. of Le Grange, Illinois.

Equipment and methods for applying a hot melt adhesive of this type are well known to those experienced in the art of bonding flexible packaging materials with hot melt adhesives. If the tube form container of this invention is manufactured from roll stock then there are two options for handling the material after forming the tube. The tube may immediately be cut into lengths equal to the length of individual containers, or the tube may be wound into rolls of convenient size for distribution to food packagers or to consumers. A roll of flattened tube stock 17 as shown at FIG. 13 may have a series of cut lines 19 to define where transverse cuts will be made to produce individual containers. Containers of the general design shown at FIGS. 3, 4 and 5 are particularly suitable for distribution in roll form because the collapsed form of the tube is of essentially uniform thickness. In contrast to container designs of the prior art, such as pouches and bags, the flat profile tube of this invention can be wound into a uniform roll without high spots corresponding to seams and other areas of extra thickness.

It is to be understood that the specific materials and methods discussed above for the manufacture of tube form microwave susceptor containers should not be taken to limit the scope of this invention. Other materials and methods may be used to make containers that exhibit the essential design and performance features of our invention. The description that has been given is intended only to provide the reader with an understanding of one manufacturing strategy. Those skilled in the art of the manufacture of laminated and coated products and in the art of converting materials into flexible containers will recognize that there are many alternative manufacturing strategies that will achieve the same end result. For example, concerning alternative materials, a stiff, flexible, heat-resistant plastic film or fabric material could be used in place of the paper component that was used in our detailed example.

We claim:

1. A tube type microwave cooking container formed from a flat rectangular paper blank including a layer of microwave susceptor material, said layer of microwave susceptor material having the property of converting microwave energy to thermal energy, the area on said flat rectangular paper blank covered by said layer of microwave susceptor material being of a generally rectangular shape, the length of said generally rectangular shape being equal to the length of said flat rectangular paper blank, the width of said generally rectangular shape being less than the width of said flat rectangular paper blank, whereby two parallel bands extend along the length of said flat rectangular paper blank and are devoid of said microwave susceptor material, two longitudinally extending bands of said flat rectangular paper blank joined together in surface to surface, facing contact along the length of said flat rectangular paper blank to thereby form said tube type microwave cooking container having both ends open, each of said two longitudinally extending bands being coextensive with at least a portion of the width of one of said two parallel bands, said tube type microwave cooking container having an interior surface, said two longitudinally extending bands joined together with facing surfaces corresponding to the same surface of said flat rectangular paper as said interior surface of said tube type microwave cooking container, said tube type microwave cooking container being collapsible to a flattened form of uniform thickness equal to two thicknesses of said flat rectangular paper blank.

2. The container of claim 1 wherein the width of said blank is greater than or equal to the length of said blank.

3. The container of claim 1 wherein the length of said blank is greater than the width of said blank.

4. The container of claim 1 including a first fold line extending across the length of said blank said first fold line running parallel to the lengthwise running edges of said blank, said first fold line dividing said blank into two generally equal halves, wherein said blank is foldable 180 degrees around said fold line to provide said flattened form of said container.

5. The container of claim 4 including two additional fold lines, said two additional fold lines running parallel to said first fold line, said two additional fold lines being adapted to form a gusset when said container is collapsed or partially collapsed, said 2 additional fold lines each spaced equally distant from said first fold line.

6. The container of claim 4 wherein said container is obtained by transversely cutting it from a roll.

7. The container of claim wherein a food release coating covers at least a portion of said interior surface.

8. The container of claim 1 including two handle forming cuts oppositely located and respectively contiguous to each of said two longitudinally extending bands.

* * * * *